United States Patent [19]

Nakashima et al.

[11] Patent Number: 4,985,390

[45] Date of Patent: Jan. 15, 1991

[54] THERMOSENSITIVE RECORDING MEDIUM

[75] Inventors: Norihiko Nakashima; Yoshiji Kanoh; Atsushi Suzuki; Sadashi Ueda, all of Wakayama, Japan

[73] Assignee: Kao Corporation, Chuo, Japan

[21] Appl. No.: 336,127

[22] Filed: Apr. 11, 1989

[30] Foreign Application Priority Data

Apr. 26, 1988 [JP] Japan ..... 63-103112

[51] Int. Cl.[5] ..... B41M 5/18

[52] U.S. Cl. ..... 503/208; 503/209; 503/225

[58] Field of Search ..... 427/150–152; 503/208, 209, 225

[56] References Cited

FOREIGN PATENT DOCUMENTS 3249690 10/1988 Japan ..... 503/209

*Primary Examiner*—Bruce H. Hess

*Attorney, Agent, or Firm*—Birch, Stewart, Kolasch & Birch

[57] ABSTRACT

A thermosensitive recording medium comprises a substrate and a thermosensitive, coloring layer, provided on the substrate, comprising a binder, a colorless or light-colored electron-donating dye, an electron-accepting compound to react with the electron-donating dye and form a coloring matter and then an ester compound obtained from a fatty acid having 20 to 28 carbon atoms and a straight or cyclic alcohol, the ester having a melting point of 50 to 100 degree C. and one or more non-phenolic hydroxy group. It is improved in prevention from fogging and sensitivity.

4 Claims, No Drawings

THERMOSENSITIVE RECORDING MEDIUM

The present invention relates to a thermal recording material. In particular, the present invention relates to a thermal recording material having an excellent coloring sensitivity and which is free from abrasion marks.

PRIOR ART

Thermal recording materials are widely used as recording materials for facsimiles, computers and various measuring instruments and apparatuses, since they are maintenance-free and relatively inexpensive and they generate no noise.

With a recent trend toward an increase in the facsimile transmission speed and the printout speed of computer terminals, a thermal recording material having a high sensitivity, i.e. a power of forming a dense color with low energy, is eagerly demanded. To increase the sensitivity, the following processes have been proposed heretofore:

(1) a process-wherein a dye or a developer is finely milled to increase the color forming efficiency (see, for example, Japanese Patent Laid-Open Nos. 15394/1981 and 76293/1983), (2) a process wherein a substance having a low melting point is added or a color developer having a low melting point is used to lower the color forming temperature (see, for example, Japanese Patent Laid-Open No. 19231/1973 and Japanese Patent Publication No. 14531/1975), (3) a process wherein the smoothness of the surface of a recording material is increased to improve the thermal conductivity (see, for example, Japanese Patent Publication No. 20142/1977), and (4) a process wherein the amount of a color forming component is increased to increase the density of the color.

Although these sensitivity increasing techniques have an advantage of increasing the recording sensitivity, they induce coloration caused by abrasion, the so-called abrasion marks, since coloration is effected with a low energy and, therefore, the products have only a low commercial value. The abrasion marks have been controlled by using petroleum wax such as paraffin wax or micro-crystalline wax or natural vegetable wax such as carnauba wax in the prior art. However, these waxes have no chemical affinity with an electron-donating dye or an electron-accepting compound such as a phenolic substance capable of forming color upon reaction with the electron-donating dye and, therefore, they impair the coloring sensitivity and accelerate the whitening of the formed color as time passes. Under these circumstances, a further development has been demanded.

An object of the present invention is to provide a thermal recording material free from the abrasion marks and having a high coloring sensitivity.

SUMMARY OF THE INVENTION

After intensive investigations made for the purpose of solving the above-described problems, the inventors have found that substances having a melting point of as low as 50° to 100° C. are effective in preventing the formation of abrasion marks and that among them, esters of a higher fatty acid having at least one non-phenolic hydroxyl group and 20 to 28 carbon atoms with a straight-chain or cyclic alcohol are capable of inhibiting the whitening with the lapse of time and have a remarkable sensitizing effect. The present invention has been completed on the basis of these findings.

A thermosensitive recording medium comprises a substrate and a thermosensitive, coloring layer, provided on the substrate, comprising a binder, a colorless or light-colored electron-donating dye, an electron-accepting compound to react with the electron-donating dye and form a coloring matter and then an ester compound obtained from a fatty acid having 20 to 28 carbon atoms and a straight or cyclic alcohol, the ester having a melting point of 50 to 100 degree C. and one or more non-phenolic hydroxy group. It is improved in prevention from fogging and sensitivity.

It is preferred that the ester is a partially esterified compound obtained from an aliphatic acid having no hydroxy group and 20 to 28 carbon atoms and a straight or cyclic polyhydric alcohol or an ester compound obtained from an aliphatic acid having a hydroxy group and 20 to 28 carbon atoms and a straight or cyclic monohydric or polyhydric alcohol.

It is preferable that the layer comprises 5 to 50 percent by weight, as the solid, of the ester compound.

The present invention provides a thermal recording material free from the abrasion marks and having a high coloring sensitivity which comprises a heat-sensitive color-forming layer formed on a base, said color-forming layer comprising a colorless or light-colored electron-donating dye and an electron-accepting compound (color developer) reactive with the electron-donating dye to form color as the main components, characterized in that the heat-sensitive color-forming layer contains an ester of a higher fatty acid having 20 to 28 carbon atoms with a straight-chain or cyclic alcohol, said ester having a melting point of 50° to 100° C. and at least one non-phenolic hydroxyl group in the molecule.

The esters of a higher fatty acid having 20 to 28 carbon atoms with a straight-chain or cyclic alcohol which have a melting point of 50° to 100° C. and at least one non-phenolic hydroxyl group in the molecule include (1) partial esters of a hydroxyl-free higher fatty acid having 20 to 28 carbon atoms with a straight-chain or cyclic polyhydric alcohol and (2) esters of a higher fatty acid having a hydroxyl group and 20 to 28 carbon atoms with a straight-chain or cyclic monohydric or polyhydric alcohol.

The higher fatty acids having 20 to 28 carbon atoms include straight-chain fatty acids such as arachic, heneicosanoic, behenic, tetracosanoic and montanic acids; and branched fatty acids such as 2-methyltetracosanoic acid. The straight-chain or cyclic polyhydric alcohols include, for example, glycerol, erythritol, arabitol, sorbitol, sorbitan, mannitol and mannitan. The esters include, for example, partial esters having a melting point of 50° to 100° C. formed from the above-mentioned higher fatty acid having 20 to 28 carbon atoms and the straight-chain or cyclic polyhydric alcohol. Examples include monoglycerides of higher fatty acids such as behenic acid, mannitan monobehenate (melting point: 67° C.) and sorbitan dibehenate (melting point: 65° C.).

Among the above-mentioned esters, higher fatty acid glycerides are particularly preferred, since they are not only effective as a sensitizing agent or abrasion mark inhibitor but are also quite effective in inhibiting blotting of the print and for heat resistance (i.e. for preventing color formation at low temperature). The inventors have investigated the influences of the number of carbon atoms of the fatty acids used for forming the higher fatty acid glycerides and glyceride composition (i.e. mono-, di- or triglyceride) to reveal that monoglycerides of higher fatty acids having 22 to 28 carbon atoms which have a monoglyceride purity of at least 70 wt. % among the glycerides are preferred, since they have not only the functions of the sensitizer and abrasion mark inhibitor but also the effects of improving the quality of the print, i.e. inhibiting the blotting of the print and improving heat resistance (preventing color formation at low temperatures). In addition, they increase the stability of the product when it is used for forming a coating layer. Among them, monoglycerides of higher fatty acids having 22 to 24 carbon atoms are particularly preferred.

The monoglycerides of higher fatty acids having 22 to 28 carbon atoms and a monoglyceride purity of at least 70 wt. % based on the total glycerides are produced by direct esterification of a higher fatty acid such as behenic, tetracosanoic or montanic acid with glycerol or by transesterification of a higher fatty acid triglyceride with glycerol. The purity of them is increased by molecular distillation with, for example, a thin-film distillation device.

The amount of the ester of the higher fatty acid having 20 to 28 carbon atoms with a straight-chain or cyclic alcohol having a melting point of 50° to 100° C. and at least one non-phenolic hydroxyl group in the molecule is preferably 5 to 50 wt. % based on the total solid content of the heat-sensitive color-forming layer. When it is less than 5 wt. %, both the sensitizing and abrasion mark inhibiting effects are reduced and, on the other hand, when it exceeds 50 wt. %, the dye content is reduced to reduce the density of the formed color.

Although the function mechanism of the ester used in the present invention has not been elucidated as of yet, it is supposed that a frictional heat generated when the surface of the thermal recording material of the present invention is rubbed is absorbed by the ester, whereby the ester is molten to inhibit the transmission of the frictional heat to the dye/developer to thereby inhibit the formation of the abrasion marks. Supposedly the non-phenolic hydroxyl group of the ester has some intermolecular interaction with the hydroxyl group of the developer to cause a eutectic phenomenon to thereby increase the sensitivity and the interaction continues even after the color formation to inhibit the sublimation of the developer or the phase separation, thus inhibiting the whitening with the lapse of time. However, when an ester of a branched polyhydric alcohol such as trimethylolpropane or pentaerythritol with a higher fatty acid is used, the dispersion stability of the heat-sensitive coating agent is poor even if it has hydroxyl residues in its molecule. The sensitivity of the heat-sensitive paper having a coating of this agent is also poor, supposedly since its molecular structure is bulkier than that of a non-branched one.

When the higher fatty acid monoglyceride having 2 to 28 carbon atoms and a monoglyceride purity of at least 70 wt. % based on the total glycerides is selected from the group of higher fatty acid glycerides, the blotting of the print is prevented, thermal resistance is improved and a stable coating material can be produced, supposedly since this compound has a melting point and HLB in suitable ranges, though the details are yet still unknown.

The electron-donating dyes used in the present invention are preferably leuco dyes such as triphenylmethane, fluoran, phenothiazine Auramine, spiropyran and indolinophthalide dyes. They can be used either alone or in the form of a mixture of two or more of them. They include, for example, the following compounds: 3,3-bis(p-dimethylaminophenyl)phthalide, 3,3-bis(p-dimethylaminophenyl)-6-dimethylaminophthalide, 3,3-bis(p-dimethylaminophenyl)-6-diethylaminophthalide, 3,3-bis(p-dimethylamonophenyl)-6-chlorophthalide, 3,3-bis(p-dibutylamonophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzofluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-(N-(3'-trifluoromethylphenyl)amino)-6-diethylaminofluoran, 2-(3,6-bis(diethylamino)-9-(o-chloroanilino)xanthylbenzoic acid lactam), 3-diethylamino-6-methyl-7-(m-trichloromethylanilino)fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)fluoran, Benzoyl Leucomethylene Blue, 6'-chloro-3'-methoxybenzindolinopyrrylospiran, 6'-bromo-3'-methoxybenzindolino pyrrylospiran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylanilinofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-benzyl-N-cyclohexylamino)-5,6-benzo-7α-naphthylamino-4'-bromofluoran, 3-diethylamino-6-methyl-7-mesidino-4',5'-benzofluoran, 3,6-dimethoxyfluoran, 3-(p-dimethylaminophenyl)-3-phenylphthalide, 3-di(1-ethyl-2-methylindol)-3-yl-phthalide, 3-diethylamino-6-phenyl-7-azafluoran, 3,3-bis(p-diethylaminophenyl)-6-dimethylaminophthalide, 2-bis(p-dimethylam:inophenyl)methyl-5-dimethylaminobenzoic acid, 3-(p-dimethylaminophenyl)-3-(p-dibenzylaminophenyl)-phthalide, 3-(N-ethyl-N-n-amyl)amino-6-methyl-7-anilinofluoran and 3-(N-ethyl-N-tetrahydrofurfuryl)amino-6-methyl-7-anilinofluoran.

The electron-accepting compounds (developers) used in the present invention are preferably phenolic compounds and hydroxybenzoic esters. Examples of them include the following compounds: 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tertbutylphenol, 4-phenylphenol, 4-hydroxydiphenoxide, α-naphthol, β-naphthol, 3,5-xylenol, thymol, methyl 4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucinol, phloroglucinolcarboxylic acid, 4-tert-octylcatechol, 2,2,-methylenebis(4-chlorophenol), 2,2'-methylenebis(4-methyl-6-tertbutylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, 1-hydroxy-2-naphthoic acid, 2-hydroxy-6-naphthoic acid, zinc 2-hydroxy-6-naphthoate, 4-hydroxydiphenyl sulfone, 4-hydroxy-4'-chlorodiphenyl sulfone, bis(4-hydroxyphenyl) sulfide and 2-hydroxy-p-toluic acid.

The electron-donating dyes and developers used in the present invention are finely milled into particles having a diameter of several microns in a dispersion medium. The dispersion medium is usually an aqueous solution of a water-soluble polymer having a concentration of about 10 wt. %. They include, for example, polyvinyl alcohol; starches and their derivatives; cellulose derivatives such as methylcellulose, hydroxyethylcellulose and carboxymethylcellulose; synthetic polymers such as polysodium acrylate, polyvinylpyrrolidone, acrylamide/acrylic ester copolymers and acrylamide/acrylic ester/methacrylic acid copolymers; sodium alginate, casein and gelatin. The dispersion is conducted with a ball mill, a sand mill or an attritor.

The water-soluble polymers used herein function as a binder for the heat-sensitive coating component after the application. A water-resisting agent can be added to the coating liquid for the purpose of imparting water resistance thereto or a binder such as styrene/butadiene latex or a polymer emulsion such as acrylic emulsion can be added thereto.

The heat-sensitive coating liquid thus prepared may further contain various additives. For example, an oil-absorbing substance such as an inorganic pigment can be added thereto in order to protect a recording head from stains. The inorganic pigments include, for example, kaolin, talc, calcium carbonate, aluminum hydroxide, magnesium hydroxide, magnesium carbonate, titanium oxide and fine particles of silica. Head travelling improvers such as fatty acids and metallic soaps can also be added thereto. They include, for example, stearic acid, behenic acid, aluminum stearate, zinc stearate, calcium stearate and zinc oleate.

The heat-sensitive coating liquid containing the above-described additives is applied to the surface of a base (such as a paper sheet or a film) by means of a blade, air knife or roll coater or by a gravure method, then dried and smoothed to obtain the thermal recording material of the present invention.

EXAMPLES

The following Examples will further illustrate the present invention. In the Examples, parts and percentages are given by weight.

In the following Examples, the esters used are those shown in Tables 1 and 2. Products 1 to 8 of the present invention and Comparative products 1 to 4 were produced by an ordinary process and purified by molecular distillation with Model 2-03 thin-film distillation apparatus (a product of Shinko Pfaudler Co., Ltd.). The monoglyceride purity was determined by separating the mono-, di- and triglycerides by GPC. The melting point was a temperature at which the melting started and determined with a differential scanning calorimeter. Product No. 9 of the present invention and Comparative Products 5 to 9 were those on the market.

TABLE 1

| | Main component | Monoglyceride purity | Number of carbon atoms of fatty acid | Melting point |
|---|---|---|---|---|
| Product of the present invention | | | | |
| 1 | montanic monoglyceride | 95% | 28 | 91.2° C. |
| 2 | " | 57 | 28 | 86.5 |
| 3 | tetracosanoic monoglyceride | 56 | 24 | 80.6 |
| 4 | behenic monoglyceride | 98 | 22 | 81.2 |
| 5 | " | 88 | 22 | 80.4 |
| 6 | " | 72 | 22 | 74.8 |
| 8 | arachic monoglyceride | 93 | 20 | 75.1 |
| 8 | " | 57 | 20 | 66.9 |
| Comparative product | | | | |
| 1 | myristic monoglyceride | 89 | 14 | 64.8 |
| 2 | " | 51 | 14 | 60.2 |
| 3 | lauric monoglyceride | 94 | 12 | 60.1 |
| 4 | " | 55 | 12 | 52.6 |

TABLE 2

| | Ester | Melting point (°C.) |
|---|---|---|
| Product of the present invention | | |
| 9 | sorbitan dibehenate | 65 |
| Comparative product | | |
| 5 | ethylene glycol distearate | 60 |
| 6 | hardened beef tallow (stearic triglyceride) | 55 |
| 7 | sorbitan monopalmitate | 46 |
| 8 | paraffin wax | 68 |
| 9 | pentaerythritol tristearate | 82 |

In the following Examples, the thermal recording materials were evaluated by the following methods:

(1) Coloring sensitivity

The coloring formation was conducted with a dynamic color forming test apparatus (a product of Ohjura Electric Co., Ltd.) with a printing energy of 0.45 mj/dot. The color density was determined with Macbeth RD-918.

(2) Whitening with the lapse of time:

The colored samples prepared in above-described method (1) were left to stand in a room for one month and the color density was again determined. The rate of retention of the density was calculated.

(3) Heat resistance

A heat gradient tester of Toyo Seiki Co., Ltd. was used. In the test, a hot plate of 55° to 95° C. was pressed against the test sample for 5 sec to form color. The color densities of the sample at these temperatures were determined with Macbeth RD-918. The temperature of the hot plate at which the value of the optical density (OD) was 0.2 (heat resistance temperature) was employed as the index of the heat resistance. The higher the heat resistance temperature, the better the heat resistance.

(4) Blotting of print

The surroundings of the colored part of the sample prepared in above process (3) at 95° C. were observed with an optical microscope at ×100 magnification. The results were evaluated as follows:

◎ : no blotting found at all,

○ : blotting scarcely observed,

Δ: slight blotting observed, and

X: blotting serious.

(5) Stability of coating agent

A compound shown in Table 1 was finely milled. The viscosity of the compound was determined immediately after the milling ($\eta^0$) and after leaving it to stand at 30° C. for two weeks ($\eta^1$). The value of $\eta^1/\eta^0$ was employed as the index of the stability of the coating agent. The closer the value of $\eta^1/\eta^0$ to 1, the higher the stability.

EXAMPLE 1

| | |
|---|---|
| (Liquid A) | |
| 3-N-methyl-N-cyclohexylamino-6-methyl-7-anilinofluoran | 10 parts |
| 10% aqueous polyvinyl alcohol solution | 10 parts |
| water | 10 parts |
| (Liquid B) | |
| 4,4'-isopropylidenediphenol | 10 parts |
| 10% aqueous hydroxyethylcellulose solution | 10 parts |
| water | 10 parts |
| (Liquid C) | |
| ester of Table 1 or 2 | 10 parts |
| calcium carbonate | 10 parts |
| 10% aqueous polyvinyl alcohol solution | 20 parts |
| water | 20 parts |
| Demol EP (a disersant of Kao Corporation; added only to the synthetic esters of Table 1) | 0.5 part |

Liquids A, B and C mentioned above were treated separately from each other with a sand mill to an average particle diameter of 3μ or less. Then 1 part of liquid A, 3 parts of liquid B and 3 parts of liquid C were mixed together to prepare a heat-sensitive coating material, which was then applied to a commercially available wood-free paper having a basis weight of 53 g/m$^2$ in a coating weight of 6 g (in terms of solid)/m$^2$, dried and smoothed with a supercalender to prepare a thermal recording material.

The thermal recording material thus obtained was tested to examine its coloring sensitivity, degree of whitening with the lapse of time, heat resistance, blotting of print and stability of the coating material. The results are shown in Table 3.

TABLE 3

| Ester | M.p. of ester (°C.) | Purity of monoglyceride (%) | Coloring sensitivity (OD) | Whitening with lapse of time (%) | Heat resistance (°C.) | Blotting of print | Stability of coating material |
|---|---|---|---|---|---|---|---|
| Product of present invention | | | | | | | |
| 1 | 91.2 | 95 | 1.23 | 95.5 | 88.7 | ◎ | 1.1 |
| 2 | 86.5 | 57 | 1.25 | 94.5 | 83.0 | ◎ | 2.8 |
| 3 | 80.6 | 56 | 1.27 | 92.3 | 78.3 | ◎ | 2.5 |
| 4 | 81.2 | 98 | 1.38 | 95.7 | 78.2 | ◎ | 1.1 |
| 5 | 80.4 | 88 | 1.39 | 93.1 | 76.1 | ◎ | 1.1 |
| 6 | 74.8 | 72 | 1.29 | 93.2 | 73.2 | ○ | 2.9 |
| 7 | 75.1 | 93 | 1.41 | 93.9 | 73.6 | ○ | 1.2 |
| 8 | 66.9 | 57 | 1.40 | 91.3 | 63.6 | Δ | 3.4 |
| Comparative product | | | | | | | |
| 1 | 64.8 | 89 | 1.43 | 87.2 | 62.8 | Δ | 1.9 |
| 2 | 60.2 | 51 | 1.42 | 87.6 | 57.5 | X | 5.9 |
| 3 | 60.1 | 94 | 1.40 | 86.3 | 58.3 | X | 1.7 |
| 4 | 52.6 | 55 | 1.40 | 86.9 | 49.2 | X | 6.8 |
| 5 | 60 | | 1.11 | 67.0 | — | — | — |
| 6 | 55 | | 1.14 | 52.3 | — | — | — |
| No ester added | — | | 0.75 | 75.2 | — | — | — |
| Dispersant alone | — | | 0.76 | 78.9 | 89.9 | ◎ | — |

Notes
Monoglyceride purity: monoglyceride/glycerides × 100 wt. %
—: no value obtained

EXAMPLE 2

| | |
|---|---|
| (Liquid A) | |
| 3-dibutylamino-7-(o-chloroanilino)-fluoran | 15 parts |
| 10% aqueous polyvinyl alcohol solution | 15 parts |
| water | 20 parts |
| (Liquid B) | |
| benzyl p-hydroxybenzoate | 10 parts |
| 10% aqueous polyvinyl alcohol solution | 20 parts |
| water | 10 parts |
| (Liquid C) | |
| calcium carbonate | 10 parts |
| ester of Table 2 | 20 parts |

-continued

| | |
|---|---|
| 10% aqueous solution of carboxyl-modified polyvinyl alcohol | 20 parts |
| water | 10 parts |

Liquids A, B and C were treated separately from each other with a sand mill to an average particle diameter of 3μ or less. Then 1 part of liquid A, 3 parts of liquid B and 2 parts of liquid C were mixed together to prepare a heat-sensitive coating material, which was then applied to a commercially available wood-free paper having a basis weight of 53 g/m$^2$ in a coating weight of 6 g (in terms of solid)/m$^2$. After drying followed by smoothing with a supercalender, a thermal recording material was obtained.

The coloring sensitivity and degree of whitening with the lapse of time of the obtained thermal recording material were determined.

EXAMPLE 3

| | |
|---|---|
| (Liquid A) | |
| 3-diethylamino-6-methyl-7-anilino-fluoran | 15 parts |
| 10% aqueous polyvinyl alcohol solution | 15 parts |
| water | 20 parts |
| (Liquid B) | |
| benzyl p-hydroxybenzoate | 5 parts |
| ester of Table 1 | 5 parts |
| calcium carbonate | 10 parts |
| 7% aqueous polyvinyl alcohol solution | 30 parts |
| Demol EP (dispersant of Kao Corporation) | 0.5 part |

Liquids A and B were treated separately from each other with a sand mill to an average particle diameter of 3μ or less. Then 1 part of liquid A was mixed with 10 parts of liquid B to prepare a heat-sensitive coating material, which was then applied to a commercially available wood-free paper having a basis weight of 53 g/m$^2$ in a coating weight of 5 g (in terms of solid)/m$^2$. After drying followed by smoothing with a supercalender, a thermal recording material was obtained.

The obtained thermal recording material was tested to determine its coloring sensitivity, degree of whitening with the lapse of time, heat resistance, blotting of print and stability of the coating material.

The results obtained in Examples 2 and 3 are shown in Table 4.

TABLE 4

| Ester | M.p. of ester (°C.) | Purity of monoglyceride (%) | Development sensitivity (OD) | Whitening with elapse of time (%) | Heat resistance (°C.) | Blotting of print | Stability of coating material |
|---|---|---|---|---|---|---|---|
| Product of the present invention | | | | | | | |
| 1 | 91.2 | 95 | 1.29 | 89.8 | 80.7 | | 1.1 |
| 2 | 86.5 | 57 | 1.32 | 87.6 | 78.6 | | 3.2 |
| 3 | 80.6 | 56 | 1.32 | 87.2 | 75.3 | | 2.9 |
| 4 | 81.2 | 98 | 1.42 | 88.7 | 73.2 | | 1.2 |
| 5 | 80.4 | 88 | 1.43 | 87.2 | 72.9 | | 1.1 |
| 6 | 74.8 | 72 | 1.34 | 85.6 | 70.2 | | 3.8 |
| 7 | 75.1 | 93 | 1.47 | 86.9 | 71.6 | | 1.1 |
| 9 | 65 | | 1.48 | 88.3 | — | — | — |
| Comparative product | | | | | | | |
| 7 | 46 | | 1.28 | 56.2 | — | — | — |
| 8 | 68 | | 1.21 | 40.1 | — | — | — |
| 9 | 82 | | 1.25 | 70.5 | — | — | — |
| No ester added | — | | 1.17 | 48.6 | — | — | — |
| Only dispersant | — | | 1.18 | 52.3 | 45.0 | | — |

Notes
Monoglyceride purity: monoglyceride/glycerides × 100 wt. %
—: no value obtained.

It is apparent from Tables 3 and 4 that the thermal recording materials of the present invention which have an excellent coloring sensitivity and which are not whitened with the lapse of time have a high commercial value. On the contrary, comparative products 1 to 4 prepared from a monoglyceride of a higher fatty acid having less than 20 carbon atoms were inferior with regard to the whitening with the lapse of time, heat resistance and blotting of the print. Comparative products 5 and 6 prepared from an ester having no non-phenolic hydroxyl group in the molecule gave poor results in the tests of the coloring sensitivity and whitening with the lapse of time because of the absence of the non-phenolic hydroxyl group in the molecule. Comparative product 7 prepared from the ester having a non-phenolic hydroxyl group in the molecule but having a melting point not higher than 50° C. was whitened with the lapse of time because of the bleeding of the ester on the surface of the thermal recording material with the lapse of time, since it had a low melting point. Comparative products 8 and 9 free of the ester of the present invention gave bad results in the tests of the coloring sensitivity and whitening with the lapse of time.

It is apparent from Tables 3 and 4 that the thermal recording material of the present invention comprising the monoglyceride of the higher fatty acid having 22 to 28 carbon atoms and also having a monoglyceride purity of at least 70 wt. % based on the total glycerides had not only excellent coloring sensitivity and resistance to the whitening with the lapse of time but also excellent heat resistance, resistance to the blotting of the print and stability of the coating material.

The abrasion marks of the products of the present invention were examined with a tester for fastness to rubbing (type of the Japan Society for Promotion of Scientific Research). In the test, the sample was rubbed with a cotton cloth 100 times and the density of the color in the rubbed part was determined with Macbeth RD-918. The products of the present invention gave only slight abrasion marks and excellent results.

We claim:

1. A thermosensitive recording medium which comprises a substrate and a thermosensitive, coloring layer provided on the substrate, said thermosensitive coloring layer comprising a binder, a colorless or light-colored electron-donating dye, an electron-accepting compound to react with said electron-donating dye to form a coloring matter and an ester compound obtained from a fatty acid having 20 to 28 carbon atoms and a straight or cyclic alcohol, said ester having a melting point of 50 to 100 degrees C. and at least one non-phenolic hydroxy group.

2. The medium as claimed in claim 1, wherein said ester is a partially esterified compound obtained from an aliphatic acid having no hydroxy group and having 20 to 28 carbon atoms and a straight or cyclic polyhydric alcohol or an ester compound obtained from an aliphatic acid having a hydroxy group and 20 to 28 carbon atoms and a straight or cyclic monohydric or polyhydric alcohol.

3. The medium as claimed in claim 1, wherein said ester is a glyceride mixture comprising 70 percent by weight or more of a monoglyceride of a fatty acid having 22 to 28 carbon atoms.

4. The medium as claimed in claim 1, wherein said layer comprises 5 to 50 percent by weight, as the solid, of the ester compound.

* * * * *